United States Patent [19]

McMullen et al.

[11] 4,053,373

[45] * Oct. 11, 1977

[54] ELECTROPLATING OF NICKEL, COBALT, NICKEL-COBALT, NICKEL-IRON, COBALT-IRON AND NICKEL-IRON-COBALT DEPOSITS

[75] Inventors: Warren H. McMullen, East Brunswick; Thomas J. Mooney, Edison, both of N.J.

[73] Assignee: M & T Chemicals Inc., Greenwich, Conn.

[ * ] Notice: The portion of the term of this patent subsequent to Mar. 29, 1994, has been disclaimed.

[21] Appl. No.: 697,032

[22] Filed: June 17, 1976

Related U.S. Application Data

[63] Continuation of Ser. No. 594,214, July 9, 1975, Pat. No. 4,014,759.

[51] Int. Cl.[2] ..... C25D 3/12; C25D 3/56

[52] U.S. Cl. ..... 204/43 T; 204/48; 204/49

[58] Field of Search ..... 204/49, 48, 43 T, 112, 204/123; 106/1

[56] References Cited

U.S. PATENT DOCUMENTS

| | | | |
|---|---|---|---|
| 2,654,703 | 10/1953 | Brown | 204/49 |
| 2,994,648 | 8/1961 | Du Rose | 204/49 |
| 3,878,067 | 4/1975 | Tremmel | 204/43 T |
| 3,922,209 | 11/1975 | Passal | 204/43 T |

*Primary Examiner*—G. L. Kaplan

*Attorney, Agent, or Firm*—Kenneth G. Wheeless; Robert P. Auber; Robert Spector

[57] ABSTRACT

In accordance with certain of its aspects this invention relates to a process and composition for the preparation of an electrodeposit which contains; at least one metal selected from the group consisting of nickel and cobalt or; binary or ternary alloys of the metals selected from nickel, iron and cobalt; which comprises passing current from an anode to a cathode through an aqueous acidic electroplating solution containing at least one member selected from the group consisting of nickel compounds and cobalt compounds and which may additionally contain iron compounds providing nickel, cobalt and iron ions for electrodepositing nickel, cobalt, nickel-cobalt alloys, nickel-iron alloys, cobalt-iron alloys or nickel-iron-cobalt alloys and containing an effective amount of at least one additive; the improvement comprising the presence of $2\times10^{-5}$ moles per liter to 0.1 moles per liter of an $\alpha$-hydroxy sulfone having the formula:

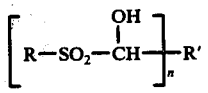

wherein R is selected from the group consisting of alkyl, aralkyl, aryl and alkaryl; R′ is hydrogen or a mono or divalent alkyl, aralkyl, aryl, or alkaryl group, or the group

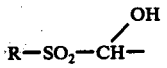

where R is as previously defined; and $n$ is an integer 1 or 2 corresponding to the valence of R′; additionally when $n$ is 2, R′ may be absent; for a time period sufficient to form a metal electroplate upon said cathode.

22 Claims, No Drawings

ELECTROPLATING OF NICKEL, COBALT, NICKEL-COBALT, NICKEL-IRON, COBALT-IRON AND NICKEL-IRON-COBALT DEPOSITS

BACKGROUND OF THE INVENTION

This is a continuation in part of U.S. patent application Ser. No. 594,214 filed July 9, 1975, now U.S. Pat. No. 4,014,759.

To conserve nickel and reduce costs a number of procedures have been adopted by the nickel plating industry. One approach to conserving nickel has been to reduce the thickness of nickel deposited. However, in order to retain the degree of brightening and leveling to which the nickel plating industry has grown accustomed, it is necessary to use more effective or "powerful" nickel brighteners or higher concentrations of nickel brighteners. The more "powerful" nickel brighteners or high concentrations of brighteners may cause unacceptable side effects along with their ability to provide bright, leveled deposits with minimal deposit thicknesses. The nickel deposits may be highly stressed, severely embrittled, less receptive to subsequent chromium deposits or exhibit hazes, reduced low current density covering power or "throw" or striations and skip plate, i.e., areas in which a deposit is not obtained.

Another method of saving nickel has been to substitute cobalt for some portion of the nickel, and thereby deposit nickel-cobalt alloys. Generally, cobalt is more expensive than nickel, but at times cobalt may be more readily available than nickel. If thinner deposits of nickel-cobalt alloys are then deposited in order to reduce costs, but higher concentrations of brighteners, or more "powerful" brighteners are employed in the plating bath to retain the desired degree of brightening and leveling, the same problems mentioned previously with respect to nickel plating may become manifest; that is, the deposits may be highly stressed, severely embrittled, hazy, striated, etc.

Electrodeposited alloys of nickel-iron, nickel-cobalt-iron or cobalt-iron are also being used commercially as substitutes for decorative nickel electrodeposits in periods when nickel is in short supply or to reduce the cost of nickel electrodeposits by substituting relatively inexpensive iron for a portion of the more expensive nickel and/or cobalt. Electrodeposited alloys containing as much as 60% by weight iron (with the remainder predominantly nickel and/or cobalt) are thus being used commercially in applications where formerly all nickel electrodeposits were considered necessary.

Although in many respects, the electrodeposition of nickel-iron, cobalt-iron or nickel-cobalt-iron alloys is very similar to the electrodeposition of nickel in that similar equipment and operating conditions are employed; nevertheless, electroplating with iron containing alloys of nickel and/or cobalt presents some special problems.

For example, one requirement in the electrodeposition of iron alloys of nickel and/or cobalt is that the iron in the electroplating solution should be predominantly in the ferrous state rather than the ferric. At a pH of about 3.5, basic ferric salts precipitate and can clog the anode bags and filters and may produce rough electrodeposits. It is, therefore, advantageous to prevent any ferric basic salts from precipitating. This can be accomplished by the addition of suitable complexing, chelating, anti-oxidant or reducing agents to the iron containing electroplating alloy bath as taught by Koretzky in U.S. Pat. No. 3,354,059; Passal in U.S. Pat. No. 3,804,726; or Clauss et al in U.S. Pat. No. 3,806,429. While these complexing or chelating agents are necessary in order to provide a solution to the ferric iron problem, their use may result in several undesirable side effects. They can cause a reduction in deposit leveling and can also produce striated, hazy or dull deposits which may further exhibit step plate or even skip plate, i.e., areas which are not plated, or else plated only very thinly compared to other sections of the deposits.

OBJECT OF THE INVENTION

It is an object of this invention to provide processes and compositions for depositing electrodeposits of nickel, cobalt, or binary or ternary alloys of the metals selected from nickel, cobalt and iron which possess a greater tolerance for high concentrations of brighteners. It is a further object of this invention to provide deposits of nickel, cobalt or binary or ternary alloys of the metals selected from nickel, cobalt and iron characterized by increased ductility, brightness, covering power, and leveling or scratch hiding ability. Other objects of this invention will be apparent from the following detailed description of this invention.

DESCRIPTION OF THE INVENTION

In accordance with certain of its aspects, this invention relates to a process for the preparation of an electrodeposit which contains at least one metal selected from the group consisting of nickel and cobalt and which may also contain iron, which comprises passing current through an aqueous, acidic plating solution containing at least one member selected from the group consisting of nickel compounds and cobalt compounds, and which may also contain iron compounds to provide nickel, cobalt and iron ions for electrodepositing nickel, cobalt, or binary or ternary alloys of nickel, cobalt and iron; the improvement comprising the presence of $2\times10^{-5}$ moles per liter to 0.1 moles per liter of an $\alpha$-hydroxy sulfone having the formula:

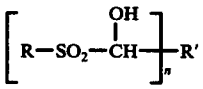

wherein R is selected from the group consisting of alkyl, aralkyl, aryl and alkaryl; R′ is hydrogen or a mono or divalent alkyl, aralky, aryl, or alkaryl group, or the group

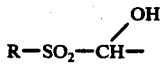

where R is as previously defined; and $n$ is an integer 1 or 2 corresponding to the valence of R′; additionally when $n$ is 2, R′ may be absent; for a time period sufficient to form a metal electroplate upon said cathode.

The baths of this invention may also contain an effective amount of at least one member selected from the group consisting of:

a. Class I brighteners
b. Class II brighteners
c. Anti-pitting or wetting agents
d. Iron complexing or solubilizing agent(s)

The term "Class I brighteners" as used herein, and as described in *Modern Electroplating*, Third Edition, F.

Lowenheim, Editor, is meant to include aromatic sulfonates, sulfonamides, sulfonimides, etc., as well as aliphatic or aromatic-aliphatic olefinically or acetylenically unsaturated sulfonates, sulfonamides, sulfonimides, etc. Specific examples of such plating additives are:

1. sodium o-sulfobenzimide
2. disodium 1,5-naphthalene disulfonate
3. trisodium 1,3,6-naphthalene trisulfonate
4. sodium benzene monosulfonate
5. dibenzene sulfonimide
6. sodium allyl sulfonate
7. sodium 3-chloro-2-butene-1-sulfonate
8. sodium βB-styrene sulfonate
9. sodium propargyl sulfonate
10. monoallyl sulfamide
11. diallyl sulfamide
12. allyl sulfonamide Such plating additive compounds, which may be used singly or in suitable combinations, are desirably employed in amounts ranging from about 0.5 to 10 grams per liter and provide the advantages described in the above reference and which are well known to those skilled in the art of electroplating.

The term "Class II brighteners" as used herein, and as described in *Modern Electroplating,* Third Edition, F. Lowenheim, Editor, is meant to include plating additive compounds such as reaction products of epoxides with alphahydroxy acetylenic alcohols such as diethoxylated 2-butyne-1, 4-diol or dipropoxylated 2-butyne-1,4-diol, other acetylenics, N-heterocyclics, active sulfur compounds, dye-stuffs, etc. Specific examples of such plating additives are:

1. 1,4-di-(β-hydroxyethoxy)-2-butyne
2. 1,4-di-(β-hydroxy-γ-chloropropoxy)-2-butyne
3. 1,4-di-(β-,γ-epoxypropoxy)-2-butyne
4. 1,4-di-(β-hydroxy-γ-butenoxy)-2-butyne
5. 1,4-di-(2'-hydroxy-4'-oxa-6'-heptenoxy)-2-butyne
6. N-(2,3-dichloro-2-propenyl)-pyridinium chloride
7. 2,4,6-trimethyl N-propargyl pyridinium bromide
8. N-allylquinaldinium bromide
9. 2-butyne-1,4-diol
10. propargyl alcohol
11. 2-methyl-3-butyn-2-ol
12. quinaldyl-N-propanesulfonic acid betaine
13. quinaldine dimethyl sulfate
14. N-allylpyridinium bromide
15. isoquinaldyl-N-propanesulfonic acid betaine
16. isoquinaldine dimethyl sulfate
17. N-allylisoquinaldine bromide
18. disulfonated 1,4-di-(β-hydroxyethoxy)-2-butyne
19. 1-(βhydroxyethoxy)-2propyne
20. 1-(β-hydroxypropoxy)-2-propyne
21. sulfonated 1-(βhydroxyethoxy)-2-propyne
22. phenosafranin
23. fuchsin When used alone or in combination, desirably in amounts ranging from about 5 to 1000 milligrams per liter, a Class II brightener may produce no visual effect on the electrodeposit, or may produce semi-lustrous, fine-grained deposits. However, best results are obtained when Class II brighteners are used with one or more Class I brighteners in order to provide optimum deposit luster, rate of brightening, leveling, bright plate current density range, low current density coverage, etc.

The term "anti-pitting or wetting agents" as used herein is meant to include a material which functions to prevent or minimize gas pitting. An anti-pitting agent, when used alone or in combination, desirably in amounts ranging from about 0.05 to 1 gram per liter, may also function to make the baths more compatible with contaminants such as oil, grease, etc. by their emulsifying, dispersing, solubilizing, etc. action on such contaminants and thereby promote attaining of sounder deposits. Preferred anti-pitting agents may include sodium, lauryl sulfate, sodium lauryl ether-sulfate and sodium di-alkylsulfosuccinates.

The nickel compounds, cobalt compounds and iron compounds employed to provide nickel, cobalt and iron ions for electrodepositing nickel, cobalt, or binary or ternary alloys of nickel, cobalt and iron, (such as nickel-cobalt, nickel-iron, cobalt-iron and nickel-cobalt-iron alloys) are typically added as the sulfate, chloride, sulfamate or fluoborate salts. The sulfate, chloride, sulfamate or fluoborate salts of nickel or cobalt are employed in concentrations sufficient to provide nickel and/or cobalt ions in the electroplating solutions of this invention in concentrations ranging from about 10 to 150 grams per liter. The iron compounds, such as the sulfate, chloride, etc. when added to the nickel, cobalt, or nickel and cobalt containing electroplating solutions of this invention, are employed in concentrations sufficient to provide iron ions ranging in concentration from about 0.25 to 25 grams per liter. The ratio of nickel ions or cobalt ions or nickel and cobalt ions to iron ions may range from about 50 to 1 to about 5 to 1.

The iron ions in the electroplating solutions of this invention may also be introduced through the use of iron anodes, rather than through the addition of iron compounds. Thus, for example, if some percentage of the total anode area in a nickel electroplating bath is composed of iron anodes, after some period of electrolysis enough iron will have been introduced into the bath by chemical or electrochemical dissolution of the iron anodes to provide the desired concentration of iron ions.

The nickel, cobalt, nickel-cobalt, nickel-iron, cobalt-iron and nickel-cobalt-iron electroplating baths of this invention additionally may contain from about 30 to 60 grams per liter, preferably about 45 grams per liter of boric acid or other buffering agents to control the pH (e.g., from about 2.5 to 5, preferably about 3 to 4) and to prevent high current density burning.

When iron ions are present in the plating baths of this invention, the inclusion of one or more iron complexing, chelating, anti-oxidizing, reducing, or other iron solubilizing agents such as citric, malic, glutaric, gluconic, ascorbic, isoascorbic, muconic, glutamic, glycollic, and aspartic acids or similar acids or their salts are desirable in the iron containing baths to solubilize iron ions. These iron complexing or solubilizing agents may range in concentration in the plating solution from about one gram per liter to about 100 grams per liter, depending on how much iron is present in the plating bath.

In order to prevent "burning" of high current density areas, provide for more even temperature control of the solution, and control the amount of iron in the iron containing alloy deposits, solution agitation may be employed. Air agitation, mechanical stirring, pumping, cathode rod and other means of solution agitation are all satisfactory. Additionally, the bath may be operated without agitation.

The operating temperature of the electroplating baths of this invention may range from about 40°C to about 85°C, preferably from about 50° C to 70°.

The average cathode current density may range from about 0.5 to 12 amperes per square decimeter, with 3 to 6 amperes per square decimeter providing an optimum range.

Typical aqueous nickel-containing electroplating baths (which may be used in combination with effective amounts of cooperating additives) include the following wherein all concentrations are in grams per liter (g/l) unless otherwise indicated:

TABLE I

AQUEOUS NICKEL-CONTAINING ELECTROPLATING BATHS

| | Minimum | Maximum | Preferred |
|---|---|---|---|
| Components: | | | |
| $NiSO_4 . 6H_2O$ | 75 | 500 | 300 |
| $NiCl_2 . 6H_2O$ | 20 | 100 | 60 |
| $H_3BO_3$ | 30 | 60 | 45 |
| pH (electrometric) | 3 | 5 | 4 |

When ferrous sulfate ($FeSO_4.7H_2O$) is included in the foregoing bath the concentration is about 2.5 grams per liter to about 125 grams per liter.

Typical sulfamate-type nickel plating baths which may be used in the practice of this invention may include the following components:

TABLE II

| | Minimum | Maximum | Preferred |
|---|---|---|---|
| Components: | | | |
| Nickel Sulfamate | 100 | 500 | 375 |
| $NiCl_2 . 6H_2O$ | 10 | 100 | 60 |
| $H_3BO_3$ | 30 | 60 | 45 |
| pH (Electrometric) | 3 | 5 | 4 |

When ferrous sulfate ($FeSO_4.7H_2O$) is included in the foregoing bath the concentration is about 2.5 grams per liter to about 125 grams per liter.

Typical chloride-free sulfate-type nickel plating baths which may be used in the practice of this invention may include the following components:

TABLE III

| | Minimum | Maximum | Preferred |
|---|---|---|---|
| Component: | | | |
| $NiSO_4 . 6H_2O$ | 100 | 500 | 300 |
| $H_3BO_3$ | 30 | 60 | 45 |
| pH (Electrometric) | 2.5 | 4 | 3–3.5 |

When ferrous sulfate ($FeSO_4.7H_2O$) is included in the foregoing baths the concentration is about 2.5 grams per liter to about 125 grams per liter.

Typical chloride-free sulfamate-type nickel plating baths which may be used in the practice of this invention may include the following components:

TABLE IV

| | Minimum | Maximum | Preferred |
|---|---|---|---|
| Component: | | | |
| Nickel sulfamate | 200 | 500 | 350 |
| $H_3BO_3$ | 30 | 60 | 45 |
| pH (Electrometric) | 2.5 | 4 | 3–3.5 |

When ferrous sulfate ($FeSO_4.7H_2O$) is included in the foregoing baths the concentration is about 2.5 grams per liter to about 125 grams per liter.

The following are aqueous cobalt-containing and cobalt-nickel-containing electroplating baths which may be used in the practice of this invention:

TABLE V

AQUEOUS COBALT-CONTAINING AND COBALT-NICKEL-CONTAINING ELECTROPLATING BATHS
(All concentrations in g/l unless otherwise noted)

| | Minimum | maximum | Preferred |
|---|---|---|---|
| Cobalt bath | | | |
| $CoSO_4 . 7H_2O$ | 50 | 500 | 300 |
| $CoCl_2 . 6H_2O$ | 15 | 125 | 60 |
| $H_3BO_3$ | 30 | 60 | 45 |
| Cobalt bath | | | |
| $CoSO_4 \cdot 7H_2O$ | 100 | 500 | 400 |
| NaCl | 15 | 60 | 30 |
| $H_3BO_3$ | 30 | 60 | 45 |
| High chloride cobalt bath | | | |
| $CoSO_4 . 7H_2O$ | 75 | 350 | 225 |
| $CoCl_2 . 6H_2O$ | 50 | 350 | 225 |
| $H_3BO_3$ | 30 | 60 | 45 |
| Cobalt-nickel alloy bath | | | |
| $NiSO_4 . 6H_2O$ | 75 | 400 | 300 |
| $CoSO_4 . 7H_2O$ | 15 | 300 | 80 |
| $NiCl_2 . 6H_2O$ | 15 | 75 | 60 |
| $H_2BO_3$ | 30 | 60 | 45 |
| All-chloride cobalt bath | | | |
| $CoCl_2 . 6H_2O$ | 100 | 500 | 300 |
| $H_3BO_3$ | 30 | 60 | 45 |
| Sulfamate cobalt bath | | | |
| Cobalt sulfamate | 100 | 400 | 290 |
| $CoCl_2 . 6H_2O$ | 15 | 75 | 60 |
| $H_3BO_3$ | 30 | 60 | 45 |

The pH in the typical formulations of Table V may range from 3 to 5 with 4 preferred.

When ferrous sulfate ($FeSO_4 . 7H_2O$) is included in the foregoing baths the concentration is about 2.5 grams per liter to 125 grams per liter.

Typical nickel-iron containing electroplating baths which may be used in the practice of this invention may include the following components:

TABLE VI

| | Minimum | Maximum | Preferred |
|---|---|---|---|
| Component: | | | |
| $NiSO_4 . 6H_2O$ | 20 | 500 | 200 |
| $NiCl_2 . 6H_2O$ | 15 | 300 | 60 |
| $FeSO_4 . 7H_2O$ | 1 | 125 | 40 |
| $H_3BO_3$ | 30 | 60 | 45 |
| pH (Electrometric) | 2.5 | 5 | 3.5–4 |

With the inclusion of ferrous sulfate ($FeSO_4.7H_2O$) in the foregoing bath formulations it is desirable to additionally include one or more iron complexing, chelating or solubilizing agents ranging in concentration from about 1 gram per liter to about 100 grams per liter, depending, of course, on the actual iron concentration.

It will be apparent that the above baths may contain compounds in amounts falling outside the preferred minimum and maximum set forth, but most satisfactory and economical operation may normally be effected when the compounds are present in the baths in the amounts indicated. A particular advantage of the chloride-free baths of Tables III and IV, supra, is that the deposits obtained may be substantially free of tensile stress and may permit high speed plating involving the use of "high speed" anodes.

The pH of all of the foregoing illustrative aqueous nickel-containing, cobalt-containing, nickel-cobalt-containing, nickel-iron, cobalt-iron and nickel-cobalt-iron-containing compositions may be maintained during plating at pH values of 2.5 to 5.0, and preferably from about 3.0 to 4.0. During bath operation, the pH may normally tend to rise and may be adjusted with acids such as hydrochloric acid, sulfuric acid, etc.

Anodes used in the above baths may consist of the particular single metal being plated at the cathode such as nickel or cobalt for plating nickel or cobalt respecively. For plating binary or ternary alloys such as nickel-cobalt, cobalt-iron, nickel-iron or nickel-cobalt-iron, the anodes may consist of the separate metals involved suitable suspended in the bath as bars, strips or small chunks in titanium baskets. In such cases the ratio of the separate metal anode areas is adjusted to correspond to the particular cathode alloy composition desired. For plating binary or ternary alloys one may also use as anodes alloys of the metals involved in such a percent weight ratio of the separate metals as to correspond to the percent weight ratio of the same metals in the cathode alloy deposits desired. These two types of anode systems will generally result in a fairly constant bath metal ion concentration for the respective metals. If with fixed metal ratio alloy anodes there does occur some bath ion imbalance, occasional adjustments may be made by adding the appropriate corrective concentration of the individual metal salts. All anodes are usually suitably covered with cloth or plastic bags of desired porosity to minimize introduction into the bath of metal particles, anode slime, etc. which may migrate to the cathode either mechanically or electrophoretically to give roughness in cathode deposits.

The substrates on which the nickel-containing, cobalt-containing, nickel-cobalt-containing, nickel-iron-containing, cobalt-iron-containing or nickel-cobalt-iron-containing electrodeposits of this invention may be applied may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as steel, copper, tin and alloys thereof such as with lead, alloys of copper such as brass, bronze, etc., zinc, particularly in the form of zinc-base die castings; all of which may bear plates to other metals, such as copper, etc. Basis metal substrates may have a variety of surface finishes depending on the final appearance desired, which in turn depends on such factors as luster, brilliance, leveling, thickness, etc. of the cobalt, nickel, or iron containing electroplate applied on such substrates.

While nickel, cobalt, nickel-cobalt, nickel-iron, cobalt-iron or nickel-iron-cobalt electrodeposits can be obtained employing the various parameters described above, the brightness, leveling ductility and covering power may not be sufficient or satisfactory for a particular application. In addition, the deposit may be hazy or dull, and also exhibit striations and step plate. These conditions may especially result after the addition of excessive replenishment amounts of Class II brighteners, or from the use of especially "powerful" Class II brighteners. In the case of the iron-containing plating baths which additionally contain iron solubilizing agents, the solubilizing agents may also cause a loss of leveling and brightness, or may result in hazy, dull or striated deposits. We have discovered that the addition or inclusion of certain bath compatible α-hydroxy sulfones, when added to these acidic nickel, cobalt, nickel-iron, cobalt-iron or nickel-iron-cobalt electroplating bath will correct the aforementioned deficiencies. Additionally, the α-hydroxy sulfone compounds of this invention permit the use of higher than normal concentrations of Class II brighteners, thus permitting high rates of brightening and leveling without the undesirable striations, skip plate, brittleness, etc. normally expected under these conditions.

These bath soluble α-hydroxy sulfones are characterized by the following generalized formula:

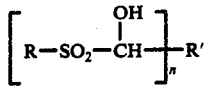

wherein R is selected from the group consisting of alkyl, aralkyl, aryl and alkaryl; R′ is hydrogen or a mono or divalent alkyl, aralkyl, aryl, or alkaryl group, or the group

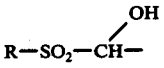

where R is as previously defined; and $n$ is an integer 1 or 2 corresponding to the valence of R′; additionally when $n$ is 2, R′ may be absent; it is understood that R and R′ may also contain bath compatible substituent groups such as chloride, bromide, sulfonate, carboxylate, etc., which is themselves do not contribute to the efficacy of the α-hydroxy sulfone moisty

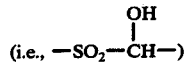

but are either inert with respect to the electroplating solution, or may provide increased bath solubility for the parent α-hydroxy sulfone.

The α-hydroxy sulfones represented by the above generalized formula may be satisfactorily prepared by reacting a suitable organic sulfinic acid (or salt thereof) with an aldehyde or dialdehyde as described in "The Organic Chemistry of Sulfur" reprinted edition, by C. M. Suter, page 691.

Suitable sulfinic acids (or their salts) are exemplified by, but not limited to, the following:

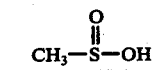

methane sulfinic acid

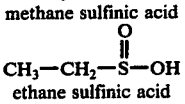

ethane sulfinic acid

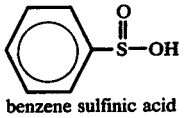

benzene sulfinic acid

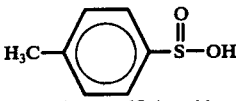

p-toluene sulfinic acid

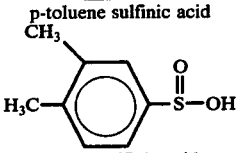

xylene sulfinic acid

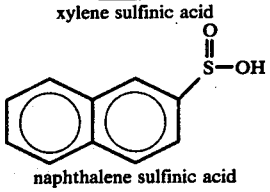

naphthalene sulfinic acid

Suitable aldehyds which may be reacted with sulfinic acids (or salts thereof) to yield the α-hydroxy sulfones of this invention are exemplified by, but not limited to:

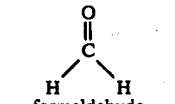
formaldehyde

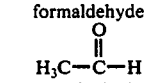
acetaldehyde

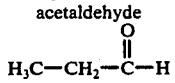
propionaldehyde

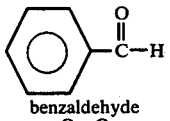
benzaldehyde

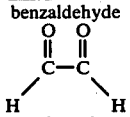
glyoxal

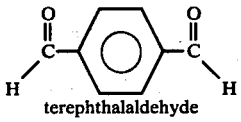
terephthalaldehyde

Typical reaction products obtained by reacting sulfinic acids (or their salts) and aldehydes, which are operable in accordance with various aspects of this invention are exemplified by, but not limited to, the following α-hydroxy sulfones:

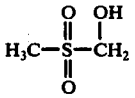
hydroxymethyl methylsulphone

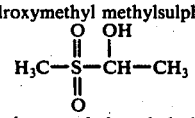
α-hydroxymethyl methylsulfone

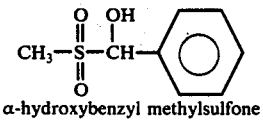
α-hydroxybenzyl methylsulfone

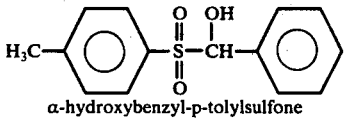
α-hydroxybenzyl-p-tolylsulfone

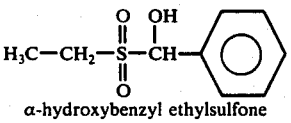
α-hydroxybenzyl ethylsulfone

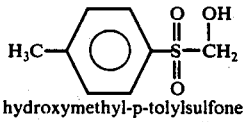
hydroxymethyl-p-tolylsulfone

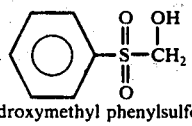
hydroxymethyl phenylsulfone

-continued

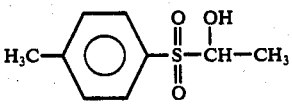
α-hydroxyethyl-p-tolylsulfone

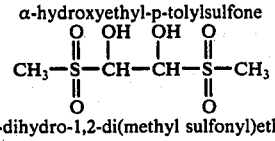
1,2-dihydro-1,2-di(methyl sulfonyl)ethane

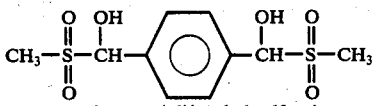
p-xylene-α,α'-di(methyl sulfone)

The α-hydroxy sulfones of this invention are typically employed either alone, or in combination with other additives as mentioned above, in concentrations ranging from about $2\times10^{-5}$ moles per liter to 0.1 moles per liter, preferably $10^{-4}$ moles per liter to $5\times10^{-2}$ moles per liter.

So that those skilled in the art of electroplating may better understand the operation of this invention, the following examples are submitted for the purpose of illustration. While these examples exemplify the operation of the invention, they are not to be construed as limiting the scope of the invention in any way.

EXAMPLE 1

Formaldehyde and p-toluenesulfinic acid were reacted together to produce hydroxymethyl-p-tolylsulfone according to the following procedure:

$$HCHO + C_6H_4(CH_3)SO_2H \rightarrow C_6H_4(CH_3)SO_2CH_2OH$$

To a 125 ml flask was added 6.25g (0.04 mole) of p-toluenesulfinic acid and 7g of 37% formaldehyde (0.08 mole). The mixture was warmed to about 35° C to hasten solution and 5 ml of concentrated hydrochloric acid were added to accelerate the reaction. After stirring the reaction mixture for 15 minutes, the crystals of product which formed were filtered and washed with cold water to remove excess hydrochloric acid and formaldehyde. The washed crystals of hydroxymethyl-p-tolylsulfone were dried under vacuum and were found to have a melting point of 84° C. The hydroxymethyl-p-tolylsulfone crystals can then be dissolved in alcohol (at a concentration of about 25 g/l) for ease in adding the material to an electroplating bath.

EXAMPLE 2

A nickel-cobalt-iron electroplating bath composition was prepared by combining in water the following ingredients to provide the indicated concentrations:

| | Grams per liter |
|---|---|
| $NiSO_4 \cdot 6H_2O$ | 300 |
| $NiCl_2 \cdot 6H_2O$ | 60 |
| $CoSO_4 \cdot 7H_2O$ | 15 |
| $FeSO_4 \cdot 7H_2O$ | 75 |
| $H_3BO_3$ | |
| Sodium o-sulfobenzimide | 4 |
| Sodium allyl sulfonate | 4.5 |
| 1,4-di(β-hydroxyehtoxy)-2-butyne | 0.05 |
| Erythorbic Acid | 7.5 |
| pH | 4.5 |
| Temperature | 60° C |

A polished brass panel was scribed with a horizontal single pass of 2/0 grit emery polishing paper to give a band about 1 cm wide at a distance of about 2.5 cm from and parallel to the bottom edge of the panel.

After cleaning the panel, including the use of a thin cyanide copper strike to assure excellent physical and chemical cleanliness, the panel was plated in a 267 ml Hull Cell, at a 2 ampere cell current for 10 minutes, at a temperature of 60° C, using magnetic stirring for agitation. The resulting nickel-cobalt-iron alloy electrodeposit was bright but rather thin and without leveling in the current density range below about 1.2 amperes per square decimeter (asd). The deposit in the region from about 1.2 to 5 asd was badly striated, exhibited step plate, poor leveling, and an iridescent haze, while from about 5 asd to the high current density edge of the test panel, the deposit was brilliant and lustrous with excellent leveling.

On adding 0.5 grams per liter ($2.7\times10^{-3}$ moles per liter) of hydroxymethyl-o-tolylsulfone to the plating solution and repeating the plating test, the resulting deposit was uniformly fine-grained, glossy, brilliant, well-leveled, ductile with slight tensile stress and excellent low current density coverage. A panel plated in the above bath gave a highly leveled bright deposit which analyzed 20% Co, 40% Fe, and 40% Ni.

EXAMPLE 3

An aqueous nickel electroplating bath was prepared having the following composition:

| | Grams per liter |
|---|---|
| $NiSO_4 \cdot 6H_2O$ | 300 |
| $NiCl_2 \cdot 6H_2O$ | 60 |
| $H_3BO_3$ | 45 |
| Sodium benzenesulfonate | 8 |
| Sodium allyl sulfonate | 3.7 |
| 1-(β-hydroxyethoxy)-2-propyne | 0.1 |
| pH | 3.5 |
| Temperature | 55° C |

A polished brass panel was scribed with a horizontal single pass of 4/0 grit emery polishing paper to give a band about 1 cm wide at a distance of about 2.5 cm from and parallel to the bottom edge of the panel. Th cleaned panel was then plated in a 267 ml Hull Cell, using the above solution, for 10 minutes at 2 amperes cell current, using magnetic stirring. The resulting nickel deposit was briliant and lustrous, but exhibited severe striations and step plate across the entire high and medium current density range of the test panel. In addition, the low current density areas, from 0.05 to about 0.6 asd had areas of skip plate (i.e., no deposit), while the rear of the panel (away from the anode) was completely devoid of deposit.

On adding 0.4 grams per liter ($2.2\times10^{-3}$ moles per liter) of hydroxymethyl-p-tolylsulfone to the nickel plating solution and repeating the plating test, the severe striations and step plated noted previously in the high and medium current density areas were eliminated and deposit leveling was noticeably improved.

EXAMPLE 4

An aqueous nickel-iron electroplating bath was prepared having the following composition:

| | Grams per liter |
|---|---|
| $NiSO_4 \cdot 6H_2O$ | 300 |

-continued

| | Grams per liter |
|---|---|
| $NiCl_2 \cdot 6H_2O$ | 60 |
| $FeSO_4 \cdot 7H_2O$ | 40 |
| $H_3BO_3$ | 45 |
| Sodium o-sulfobenzimide | 2.7 |
| Sodium allyl sulfonate | 3.5 |
| 1-(β-hydroxyethoxy)-2-propyne | 0.005 |
| 1,4-di(β-hydroxyethoxy)-2-butyne | 0.05 |
| Erythorbic Acid | 8 |
| pH | 3.8 |
| Temperature | 55° C |

The Hull Cell test procedure and conditions described in Examples 2 and 3 were employed to obtain a nickel-iron alloy deposit from the above solution. The resulting deposit was bright, but badly streaked and striated with thin areas and haze in the medium current density, poor leveling and poor low current density coverage or "throwing" power.

On adding 0.12 grams per liter ($6.5\times10^{-4}$ moles per liter) of hydroxymethyl-p-tolylsulfone to the nickel-iron plating solution and repeating the plating test, the resulting nickel-iron alloy deposit was found to be uniformly bright over the entire current density range of the test panel and the deposit was free of the striations, haze and poor coverage noted above. In addition, the leveling, as evidenced by the obliteration of the emery scratches, was significantly improved.

Although this invention has been illustrated by reference to specific embodiments, modifications thereof which are clearly within the scope of the invention will be apparent to those skilled in the art.

What is claimed is:

1. In a process for the preparation of an electrodeposit which contains; at least one metal selected from the group consisting of nickel and cobalt or; binary or ternary alloys of the metals selected from nickel, iron, and cobalt; which comprises passing current from an anode to a cathode through an aqueous acidic electroplating solution containing at least one member selected from the group consisting of nickel compounds and cobalt compounds and which may additionally contain iron compounds providing nickel, cobalt and iron ions for electrodepositing nickel, cobalt, nickel-cobalt alloys, nickel-iron alloys, cobalt-iron alloys or nickel-iron-cobalt alloys and containing at least one additive; the improvement comprising the presence of $2\times10^{-5}$ moles per liter to 0.1 moles per liter of an α-hydroxy sulfone having the formula:

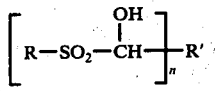

wherein R is selected from the group consisting of alkyl, aralkyl, aryl and alkaryl; R′ is hydrogen or a mono or divalent alkyl, aralkyl, aryl, or alkaryl group, or the group

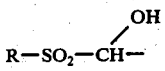

wherein R is as previously defined; and $n$ is an integer 1 or 2corresponding to the valence of R′; provided that when $n$ is 2, R′ is present or absent; for a time period sufficient to form a metal electroplate upon said cathode.

2. The process of claim 1 wherein at least one α-hydroxysulfone is hydroxymethyl methylsulfone.

3. The process of claim 1 wherein at least one α-hydroxysulfone is α-hydroxymethylsulfone.

4. The process of claim 1 wherein at least one α-hydroxysulfone is α-hydroxybenzyl methylsulfone.

5. The process of claim 1 wherein at least one α-hydroxysulfone is α-hydroxybenzyl-p-tolylsulfone.

6. The process of claim 1 wherein at least one α-hydroxysulfone is α-hydroxybenzyl ethylsulfone.

7. The process of claim 1 wherein at least one α-hydroxysulfone is hydroxymethyl-p-tolylsulfone.

8. The process of claim 1 wherein at least one α-hydroxysulfone is hydroxymethyl phenylsulfone.

9. The process of claim 1 wherein at least one α-hydroxysulfone is α-hydroxyethyl-p-tolylsulfone.

10. The process of claim 1 wherein at least one α-hydroxysulfone is 1,2-dihydroxy-1,2-di(methylsulfonyl)ethane.

11. The process of claim 1 wherein at least one α-hydroxysulfone is p-xylene-α,α'-di(methyl sulfone).

12. In a composition for the preparation of an electrodeposit which contains; at least one metal selected from the group consisting of nickel and cobalt or; binary or ternary alloys of the metals selected from nickel, iron, and cobalt; which comprises an aqueous acidic electroplating solution containing at least one member selected from the group consisting of nickel compounds and cobalt compounds and iron compounds providing nickel, cobalt and iron ions for electrodepositing nickel, cobalt, nickel-cobalt alloys, nickel-iron alloys, cobalt-iron alloys or nickel-iron-cobalt alloys and containing at least one additive; the improvement comprising the presence of $2\times10^{-5}$ moles per liter to 0.1 moles per liter of an α-hydroxy sulfone having the formula:

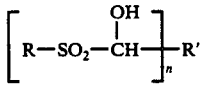

wherein R is selected from the group consisting of alkyl, aralkyl, aryl and alkaryl; R' is hydrogen or a mono or divalent alkyl, aralkyl, aryl, or alkaryl group, or the group

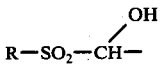

where R is as previously defined; and $n$ is an integer 1 or 2 corresponding to the valence of R'; provided that when $n$ is 2, R' is present or absent.

13. The composition of claim 12 wherein at least one α-hydroxysulfone is hydroxymethyl methylsulfone.

14. The composition as claimed in claim 12 wherein at least α-hydroxysulfone is α-hydroxyethyl methylsulfone.

15. The composition as claimed in claim 12 wherein at least one α-hydroxysulfone is α-hydroxybenzyl methylsulfone.

16. The composition as claimed in claim 12 wherein at least one α-hydroxysulfone is α-hydroxybenzyl-p-tolylsulfone.

17. The composition of claim 12 wherein at least one α-hydroxysulfone is α-hydroxybenzyl ethylsulfone.

18. The composition as claimed in claim 12 wherein at least one α-hydroxysulfone is hydroxymethyl-p-tolylsulfone.

19. The composition as claimed in claim 12 wherein at least one α-hydroxysulfone is hydroxymethyl phenylsulfone.

20. The composition as claimed in claim 12 wherein at least one α-hydroxysulfone is α-hydroxyethyl-p-tolylsulfone.

21. THe composition as claimed in claim 12 wherein at least one α-hydroxysulfone is 1,2-dihydroxy-1,2-di(methyl sulfonyl)ethane.

22. The composition of claim 12 wherein at least one α-hydroxylsulfone is p-xylene-α,α'-diol-α,α'-di (methyl sulfone)

* * * * *